US007311138B2

(12) United States Patent
Kazari et al.

(10) Patent No.: US 7,311,138 B2
(45) Date of Patent: Dec. 25, 2007

(54) STACKING-TYPE, MULTI-FLOW, HEAT EXCHANGERS AND METHODS FOR MANUFACTURING SUCH HEAT EXCHANGERS

(75) Inventors: Kengo Kazari, Isesaki (JP); Tomohiro Chiba, Isesaki (JP); Takayuki Ohno, Isesaki (JP)

(73) Assignee: Sanden Corporation, Gunma (JP)

( * ) Notice: Subject to any disclaimer, the term of this patent is extended or adjusted under 35 U.S.C. 154(b) by 0 days.

(21) Appl. No.: 11/135,370

(22) Filed: May 24, 2005

(65) Prior Publication Data

US 2005/0263271 A1 Dec. 1, 2005

(30) Foreign Application Priority Data

May 26, 2004 (JP) ..... 2004-156382

(51) Int. Cl.
*F28D 1/04* (2006.01)
*F28F 9/04* (2006.01)

(52) U.S. Cl. ..... 165/153; 165/178

(58) Field of Classification Search ..... 165/167, 165/166, 153, 178, 76, 147; 285/222; 29/890.043, 29/890.044; 704/201, 203, 205, 219, 230, 704/232

See application file for complete search history.

(56) References Cited

U.S. PATENT DOCUMENTS 4,678,112 A 7/1987 Koisuka et al.
4,867,486 A * 9/1989 Fukata et al. ..... 285/222
4,969,512 A 11/1990 Hisao et al.
5,088,193 A 2/1992 Okada et al.
5,099,576 A 3/1992 Shinmura
5,101,887 A 4/1992 Kado
5,119,552 A 6/1992 Sutou et al.
5,148,429 A 9/1992 Kudo et al. ..... 370/473
5,172,762 A 12/1992 Shinmura et al.
5,174,373 A 12/1992 Shinmura
5,211,222 A 5/1993 Shinmura
5,214,847 A 6/1993 Aoki
5,255,672 A 10/1993 Jinotti
5,348,079 A 9/1994 Tanaka
5,412,642 A 5/1995 Nunokawa ..... 370/253
5,414,796 A 5/1995 Jacobs et al. ..... 704/221
5,505,254 A 4/1996 Chiba
5,630,326 A * 5/1997 Nishishita et al. ..... 62/299
5,632,331 A 5/1997 Shinmura
5,782,291 A 7/1998 Morita (Continued)

FOREIGN PATENT DOCUMENTS

JP 62046195 A * 2/1987

*Primary Examiner*—Tho Duong
(74) *Attorney, Agent, or Firm*—Baker Botts L.L.P.

(57) ABSTRACT

A stacking-type, multi-flow, heat exchanger includes heat transfer tubes and fins, which are stacked alternately, an end plate disposed at an outermost position of the stacked heat transfer tubes and fins in a stacking direction, and inlet and outlet pipes connected to the end plate. The heat exchanger includes a pipe connection plate provided on the end plate, having a pipe insertion hole formed therethrough, into which at least one of the inlet and outlet pipes is inserted and which temporarily fixes an end portion of an inserted pipe in the pipe insertion hole. The pipe connection plate and the entire heat exchanger may be formed with a reduced size and weight, and the brazing quality between the plate and the pipe may be improved.

16 Claims, 5 Drawing Sheets

U.S. PATENT DOCUMENTS

| | | | | |
|---|---|---|---|---|
| 5,785,119 | A | 7/1998 | Watanabe et al. | |
| 5,894,886 | A | 4/1999 | Chiba et al. | |
| 5,934,367 | A | 8/1999 | Shimmura et al. | |
| 5,960,864 | A | 10/1999 | Morita | |
| 5,975,197 | A | 11/1999 | Kado | |
| 6,035,931 | A | 3/2000 | Kado et al. | |
| 6,070,659 | A | 6/2000 | Hosoya | |
| 6,196,306 | B1 * | 3/2001 | Aikawa et al. | 165/178 |
| 6,257,325 | B1 | 7/2001 | Watanabe et al. | |
| 6,453,990 | B2 * | 9/2002 | Higashiyama et al. | 165/178 |
| 6,543,530 | B2 * | 4/2003 | Watanabe | 165/178 |
| 2002/0129926 | A1 * | 9/2002 | Yamaguchi | 165/41 |
| 2005/0173101 | A1 | 8/2005 | Ohno | |

* cited by examiner

STACKING-TYPE, MULTI-FLOW, HEAT EXCHANGERS AND METHODS FOR MANUFACTURING SUCH HEAT EXCHANGERS

BACKGROUND OF THE INVENTION

This application claims the benefit of Japanese Patent Application No. 2004-156382 filed May 26, 2004, which is incorporated herein by reference.

1. Field of the Invention

The present invention relates to stacking-type, multi-flow, heat exchangers, each comprising heat transfer tubes and fins, which are stacked alternately, and an end plate provided at an outermost position, which is provided with inlet and outlet pipes. Further, the invention relates to methods for manufacturing such heat exchangers. More specifically, the present invention relates to a structure of a pipe connection portion of a stacking-type, multi-flow, heat exchanger suitable as a heat exchanger for use in an air conditioning system, in particular, for vehicles.

2. Description of Related Art

Stacking-type, multi-flow, heat exchangers having alternately stacked heat transfer tubes and fins, and an end plate with inlet and outlet pipes provided at an outermost position in the stacking direction, are known, for example, as disclosed in Japanese Patent Application No. JP-A-2001-241881, which is incorporated herein by reference. In such a heat exchanger, a plate for pipe connection is connected to the end plate, and inlet and outlet pipes are inserted into holes formed through the plate for pipe connections.

However, in stacking-type, multi-flow, heat exchangers, such as a heat exchanger disclosed in Japanese Patent Application No. JP-A-2001-241881, because it is necessary to form a raised or elongated portion or portions on the plate for pipe connection, a plate having a sufficiently raised or elongated portion or portions is required for forming the plate for pipe connection. In particular, if a dimension of the plate in a thickness direction of the heat exchanger (e.g., an air flow direction) is not ensured, forming the raised or elongated portion or portions may become difficult. Therefore, because of the required plate size, the size and the weight of the entire heat exchanger may increase.

Further, such a heat exchanger is manufactured by brazing temporarily assembled parts simultaneously in a furnace. Because a raised or elongated portion(s) generally does(do) not have a precise dimension, it is necessary to interpose a separate member made of a brazing material, for example, a ring-like brazing material, between the raised or elongated portion(s) and a pipe(s) inserted thereinto, in order to achieve a properly brazed connection. When the raised or elongated portions and the inlet and outlet pipes are brazed to each other via a separate member of brazing material positioned therebetween, if the brazing-material member shifts from its proper position during brazing and other stages, the brazing quality may be reduced.

SUMMARY OF THE INVENTION

Accordingly, a need has arisen to provide a stacking-type, multi-flow, heat exchanger, in which a plate for pipe connection may be made of a reduced size and weight, and a brazing quality between the plate for pipe connection and an inlet pipe or an outlet pipe, or both, may be improved.

To achieve the foregoing and other objects, the structure of a stacking-type, multi-flow, heat exchanger, according to the present invention, is provided. The stacking-type, multi-flow, heat exchanger comprises a plurality of heat transfer tubes and a plurality of fins, which are stacked alternately, an end plate disposed at an outermost position of the stacked heat transfer tubes and fins in a stacking direction, and an inlet pipe and an outlet pipe connected to the end plate. The heat exchanger further comprises a pipe connection plate disposed on the end plate, and the pipe connection plate comprises a pipe insertion hole formed therethrough, into which at least one of the inlet and outlet pipes is inserted and which temporarily fixes an end portion of an inserted pipe in the pipe insertion hole.

In such a structure, the pipe insertion hole is formed through the pipe connection plate itself, not by way of a raised or elongated portion, but by machining or the like. The pipe insertion hole may be formed or opened through the plate with a high degree of accuracy, and the pipe to be inserted into the pipe insertion hole may be inserted with a high degree of accuracy, in order to temporarily fix the end portion of the pipe in the pipe insertion hole. Because it is not necessary to provide a raised or elongated portion, the pipe connection plate may be formed with a reduced size and weight, and the entire heat exchanger may be formed with a reduced size and weight, as compared with known heat exchangers using a plate with a raised or elongated portion or portions.

Further, because the end portion of the pipe and the pipe insertion hole may engage each other without a significant gap, it is not necessary to interpose a separate member of brazing material between the end portion of the pipe and the inner circumferential surface of the pipe insertion hole in order to braze them to each other in a furnace. Because it is not necessary to use a separate member of brazing material, there is no danger of a shift of the brazing-material member, as in known heat exchangers. Therefore, when temporarily assembled parts for forming the heat exchanger are brazed together substantially simultaneously in a furnace, the pipe connection plate and the pipe inserted into the plate may be brazed readily at a desired brazing quality.

In such a structure according the present invention, it is preferred that a surface of the pipe connection plate is covered or clad with a brazing material. By this structure, the pipe connection plate and the pipe inserted into the plate may be brazed to each other more readily.

Further, in a preferred embodiment, the end portion of the inserted pipe is caulked to the pipe connection plate. In such a configuration, the pipe and the pipe connection plate may be fixed to each other more securely, and the pipe and the pipe connection plate may be held at a desired orientation and position relative to the end plate, in particular, at the time of brazing.

Further, an end surface of the end portion of the inserted pipe preferably is disposed flush with a connection surface of the pipe connection plate adjoining the end plate or at a position inward of connection surface in the pipe insertion hole. In such a configuration, substantially, the entire connection surface of the pipe connection plate may be connected and brazed to the end plate securely and readily.

The pipe insertion hole may be formed with an appropriate cross-sectional shape. For example, an inner circumferential surface of the pipe insertion hole may be formed as a tapered surface or as a stepped surface. In such a structure, by inserting an end portion of a pipe and, for example, by enlarging the diameter of the inserted pipe, the pipe end portion may be securely fixed to the pipe connection plate. Alternatively, the pipe end portion may be temporarily fixed by press fitting.

Further, it is preferred that a width of the pipe connection plate perpendicular to the stacking direction of the end plate is less than or equal to a width of the end plate. In such a configuration, because there is no portion projecting from the temporarily assembled heat exchanger in its thickness direction, (i.e., perpendicular to the stacking direction) the temporarily assembled heat exchanger may be placed in a horizontally extending condition into a furnace for brazing, thereby brazing the temporarily assembled heat exchanger more securely and more readily.

Further, it is preferred that an outer surface of the pipe connection plate is flush with an outer surface of an end plate portion, to which an outermost fin is connected. Because a temporarily assembled heat exchanger may be held by a jig, nipping the assembly from both sides in the tube/fin stacking direction, in the above-described configuration, the structure of the jig may be less complicated.

Further, a mechanism for engaging the pipe connection plate with the end plate may be disposed between the pipe connection plate and the end plate. In such a configuration, the pipe connection plate may be disposed relative to the end plate at a desired position more readily.

Thus, in the stacking-type, multi-flow, heat exchanger, according to the present invention, the pipe connection plate and the entire heat exchanger may be formed with a reduced size and weight, and the brazing quality between the pipe connection plate and the inlet pipe or the outlet pipe, or both, may be increased.

Further objects, features, and advantages of the present invention will be understood from the following detailed description of preferred embodiments of the present invention with reference to the accompanying figures.

BRIEF DESCRIPTION OF THE DRAWINGS

Embodiments of the invention now are described with reference to the accompanying figures, which are given by way of example only, and are not intended to limit the present invention.

DETAILED DESCRIPTION OF PREFERRED EMBODIMENTS

Figure 1:
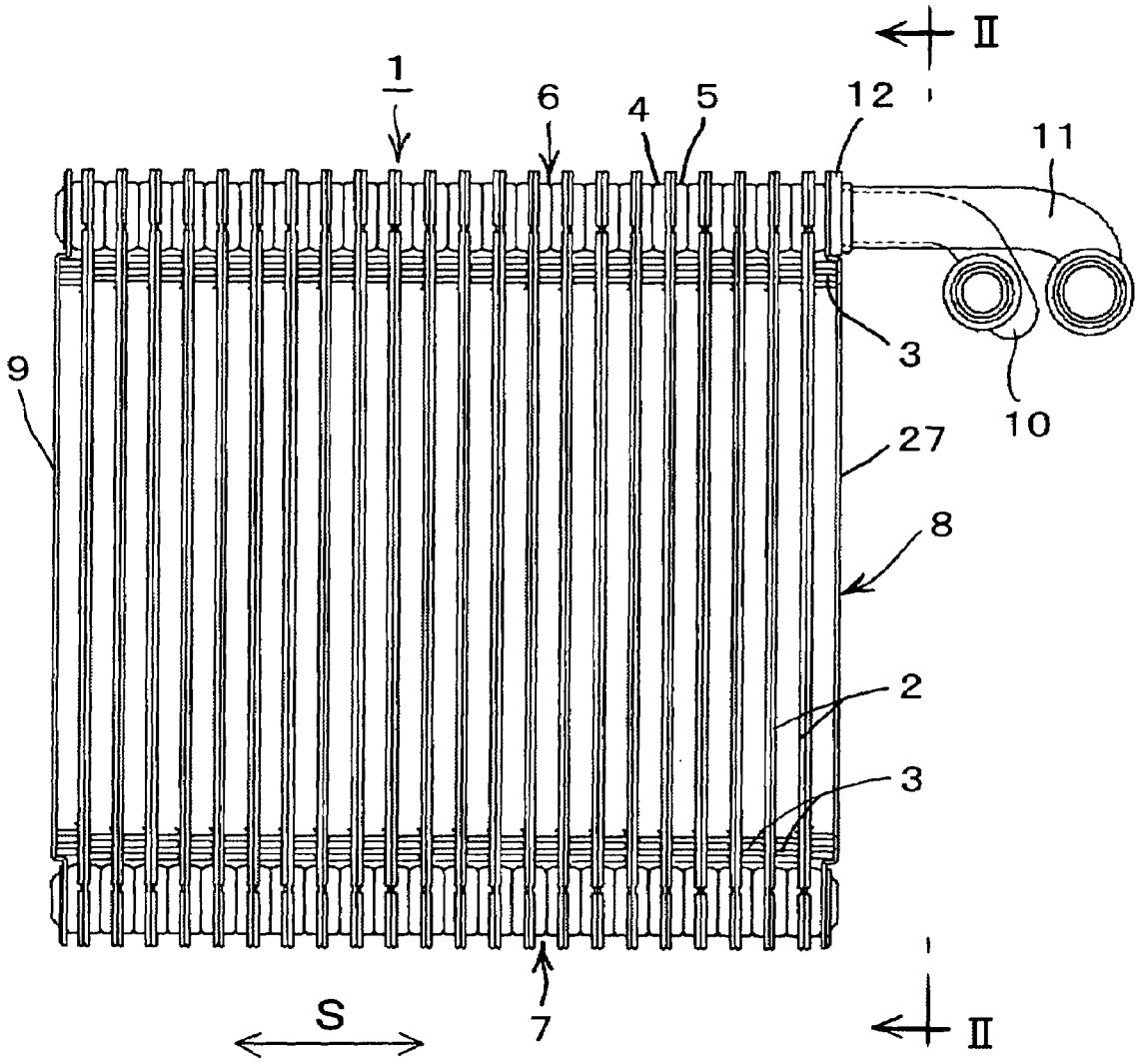
FIG. 1 is a plan view of a stacking-type, multi-flow, heat exchanger, according to a first embodiment of the present invention.
Figure 2:
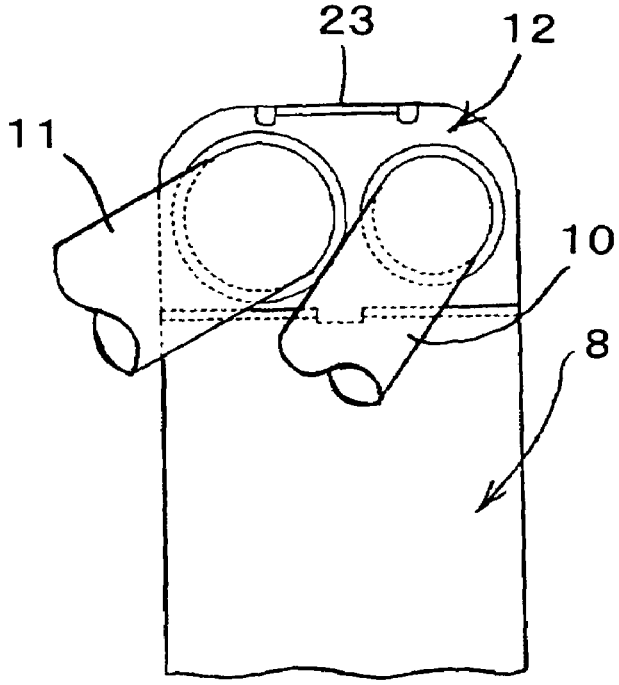
FIG. 2 is an enlarged, partial, side view of the heat exchanger depicted in FIG. 1, as viewed along Line II-II of FIG. 1.
Figure 3:
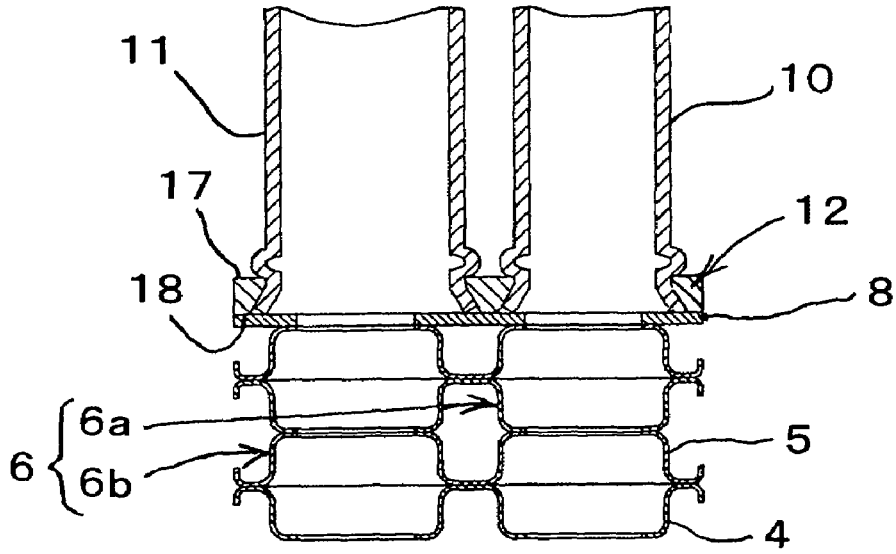
FIG. 3 is an enlarged, partial, cross-sectional view of a pipe connection portion of the heat exchanger depicted in FIG. 2.

Referring to FIGS. 1-8, a stacking-type, multi-flow, heat exchanger is depicted according to a first embodiment of the present invention. Heat exchanger 1 comprises a plurality of heat transfer tubes 2 and a plurality of fins 3 stacked alternately. Each heat transfer tube 2 is formed by connecting a pair of tube plates 4 and 5 to each other at their circumferential portions. In each heat transfer tube 2, a passage for fluid (for example, refrigerant) is formed (not shown). Tanks 6 and 7 are connected to both ends of stacked heat transfer tubes 2 to communicate between tanks 6 and 7 via heat transfer tubes 2. End plates 8 and 9 are provided at the outermost positions of the stacked heat transfer tubes 2 and fins 3 in the stacking direction. (Arrow S)

A pipe connection plate 12, to which an inlet pipe 10 for introducing a fluid into heat exchanger 1 and an outlet pipe 11 for discharging the fluid from heat exchanger 1 are connected, is connected to end plate 8. Pipe insertion hole 13, into which inlet pipe 10 is inserted, and pipe insertion hole 14, into which outlet pipe 11 is inserted, are formed through pipe connection plate 12. Holes 15 and 16 are provided on end plate 8 at positions corresponding to pipe insertion holes 13 and 14 of pipe insertion hole 14, respectively. Inlet pipe 10 communicates with a first chamber 6*a* (an inlet side tank) of tank 6, and outlet pipe 11 communicates with a second chamber 6*b* (an outlet side tank) of tank 6.

Figure 5:
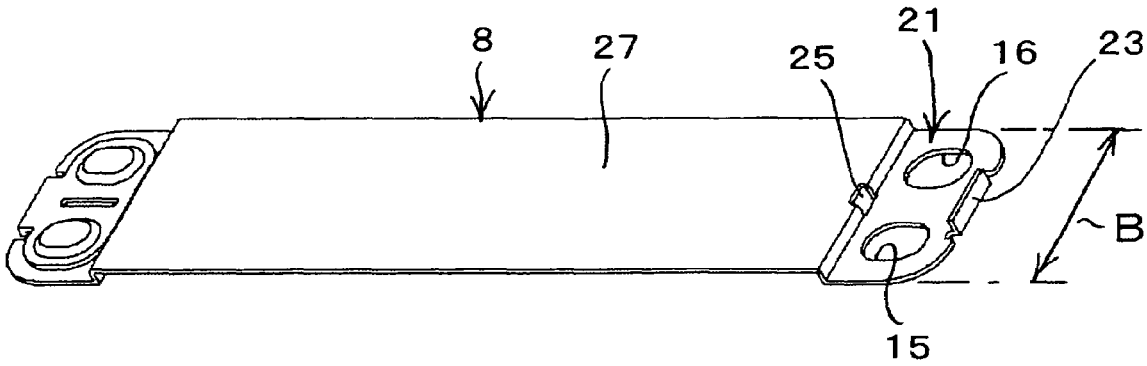
FIG. 5 is a perspective view of an end plate of the heat exchanger depicted in FIG. 1.
Figure 6:
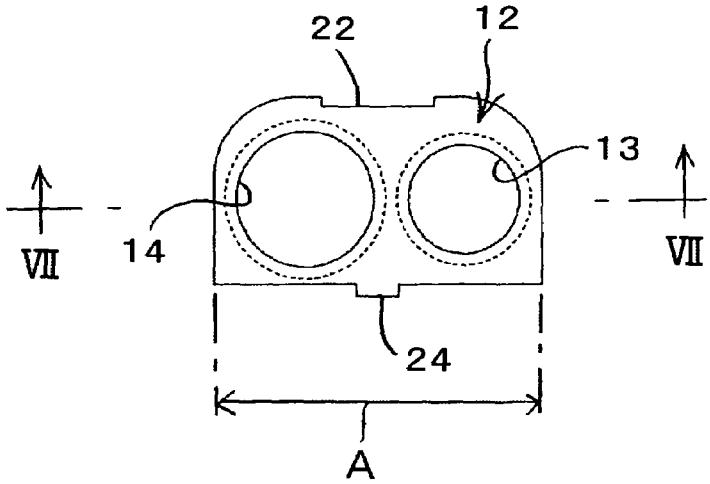
FIG. 6 is a plan view of a pipe connection plate of the heat exchanger depicted in FIG. 1.
Figure 7:
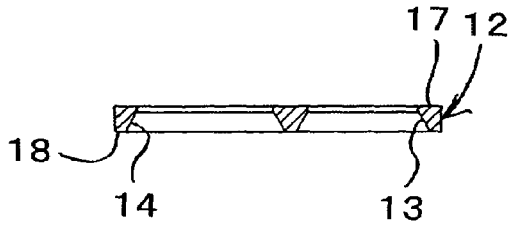
FIG. 7 is a cross-sectional view of the pipe connection plate depicted in FIG. 6, as viewed along Line VII-VII of FIG. 6.

Pipe connection plate 12 comprises a clad plate, which is covered with a brazing material. As depicted in FIGS. 5 and 6, a width A of pipe connection plate 12 perpendicular to the stacking direction of end plate 8 is less than or equal to a width B of end plate 8. The inner circumferential surfaces of pipe insertion hole 13 and 14 of pipe connection plate 12 are formed as tapered surfaces, respectively, so that the diameter of each pipe insertion hole 13 and 14 is increased from a pipe insertion side surface 17 toward an end plate connection side surface 18, as depicted in FIG. 7.

Figures 8A, 8B, 8C:
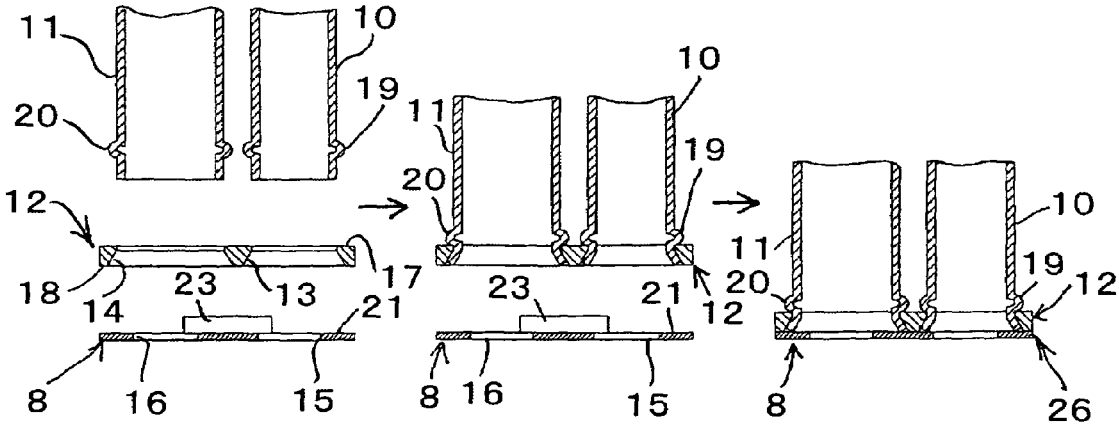
FIGS. 8A-8C are cross-sectional, sequential views of the pipe connection portion of the heat exchanger depicted in FIG. 1, showing an example of a method for connecting pipes to the pipe connection plate.

The parts of heat exchanger 1 is brazed together, substantially simultaneously in a furnace, after respective parts are temporarily assembled. In this embodiment, for example, a pipe connection portion is temporarily assembled, as depicted in FIGS. 8A-8C. First, pipes 10 and 11 are modified to form protruded portions 19 and 20, as depicted in FIG. 8A. Then, pipes 10 and 11 are inserted into pipe insertion holes 13 and 14, respectively, of pipe connection plate 12 from pipe insertion side surface 17. At that time, the pipe insertion depicts of respective pipes 10 and 11 are regulated to a desired depth by protruded portions 19 and 20. The end portions of the inserted pipes 10 and 11 are caulked to the tapered surfaces of pipe insertion hole 13 and 14 of pipe connection plate 12, as depicted in FIG. 8B. At that time, the end surfaces of the end portions of the inserted pipes 10 and 11 are positioned to be substantially flush with end plate connection side surface 18 of pipe connection plate 12. Then, pipe connection plate 12, to which pipes 10 and 11 are temporarily fixed, is engaged with connection portion 21 of end plate 8 and temporarily fixed to end plate 8, as depicted in FIG. 8C. In this embodiment, during the temporary fixing, claw 23 of end plate 8 may be engaged with or caulked to notch 22 formed on pipe connection plate 12, and a projection of pipe connection plate 12 is inserted into slot 25 defined on end plate 8. Thus, an engaging mechanism 26 is formed between pipe connection plate 12 and end plate 8.

Figure 4:
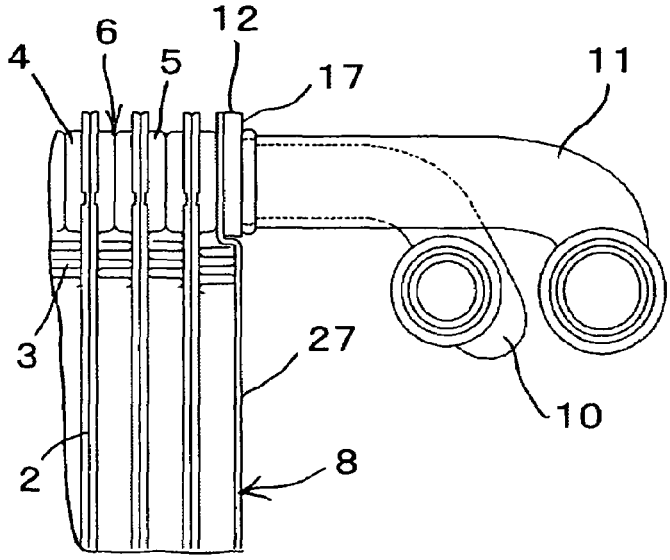
FIG. 4 is an enlarged, partial, plan view of the heat exchanger depicted in FIG. 1.

In this embodiment, when pipe connection plate 12 is engaged with and temporarily fixed to end plate via such engaging mechanism 26, as depicted in FIG. 4, pipe insertion side surface 17 of pipe connection plate 12 also is substantially flush with an outer surface 27 of the end plate portion of end plate 8, to which an outermost fin 3 is connected.

In the embodiment thus constructed, because pipe insertion holes 13 and 14, which are inserted with inlet and outlet pipes 10 and 11 and are capable of temporarily fixing the end portions of the inserted pipes 10 and 11, are provided on pipe connection plate 12, the outer surfaces of the end portions of the inserted pipes 10 and 11 may be temporarily fixed securely and readily only by inserting the end portions of pipes 10 and 11 into pipe insertion holes 13 and 14. Therefore, the temporarily assembled parts may be brazed readily and substantially simultaneously, in a furnace, without providing a brazing-material member between inner circumferential surfaces of holes and inserted pipes, which has been required in known heat exchangers having raised or elongated portions formed on a plate for pipe connection. Because it is not necessary to form such raised or elongated portions, pipe connection plate 12 may be formed with a reduced size and weight, as compared with known plates formed with raised or elongated portions, and the entire heat exchanger also may be made with a reduced size and weight.

Further, because pipe connection plate 12 is constructed from a clad plate covered with a brazing material, the pipe connection plate 12, end plate 8 and pipes 10 and 11 may be brazed readily and securely. Moreover, because pipe connection plate 12 and end plate 8 are temporarily fixed to each other securely via engaging mechanism 26, both members may be brazed at a desired orientation, more securely.

Moreover, in this embodiment, because the inner circumferential surfaces of pipe insertion holes 13 and 14 are formed as tapered surfaces, for example, by enlarging the diameters of the end portions of inserted pipes 10 and 11 after inserting the pipes 10 and 11, the pipe end portions may be temporarily fixed to pipe connection plate 12, more securely.

Because the end surfaces of the end portions of inserted pipes 10 and 11 are substantially flush with connection side surface 18 of pipe connection plate 12, the entire surface 18 also may be brazed to connection portion 21 of end plate 8 more readily and more securely.

Further, because width A of pipe connection plate 12 is less than or equal to width B of end plate 8, pipe connection plate 12 does not project from end plate 8 perpendicular to the stacking direction. Therefore, the temporary assemble may be readily placed horizontally in a furnace, and the brazing property may be further improved.

In addition, because pipe insertion side surface 17 of pipe connection plate 12 is substantially flush with outer surface 27 of the end plate portion connected with outermost fin 3, a jig for fixing the assembly from both sides in the stacking direction may be less complicated in structure.

Figure 9:
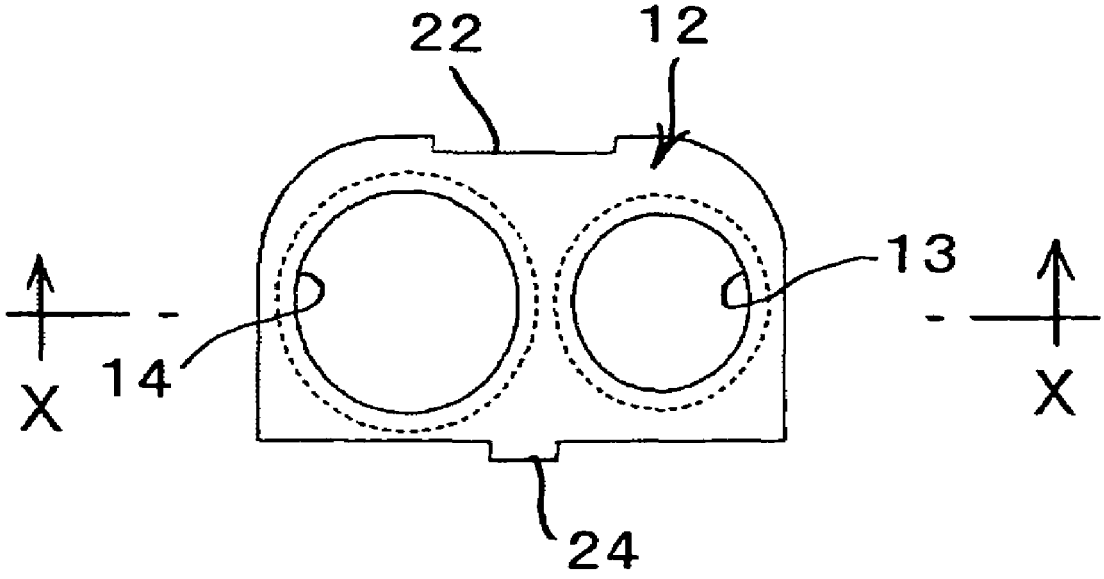
FIG. 9 is a plan view of a pipe connection plate of a stacking-type, multi-flow, heat exchanger, according to a second embodiment of the present invention.
Figure 10:
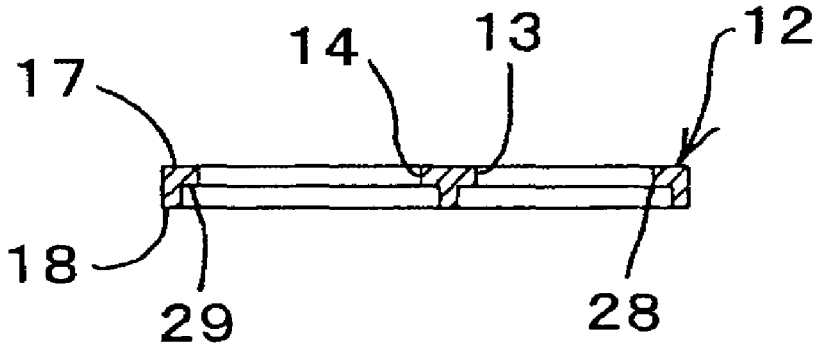
FIG. 10 is a cross-sectional view of the pipe connection plate depicted in FIG. 9, as viewed along Line X-X of FIG. 9.

FIGS. 9 and 10 depict a pipe connection plate of a stacking-type, multi-flow, heat exchanger, according to a second embodiment of the present invention. In this embodiment, the inner circumferential surfaces of pipe insertion holes 13 and 14 of pipe connection plate 12 are formed as stepped surfaces 28 and 29. Other portions are substantially the same as those in the first embodiment. In this embodiment, by enlarging the diameters of the end portions of inserted pipes 10 and 11 in steps, after inserting the pipes 10 and 11, the pipe end portions also may be temporarily, but more securely, fixed to pipe connection plate 12.

Although embodiments of the present invention have been described in detail herein, the scope of the invention is not limited thereto. It will be appreciated by those skilled in the art that various modifications may be made without departing from the scope of the invention. Accordingly, the embodiments disclosed herein are only exemplary. It is to be understood that the scope of the invention is not to be limited thereby, but is to be determined by the claims which follow.

What is claimed is:

1. A stacking-type, multi-flow, heat exchanger comprising a plurality of heat transfer tubes and a plurality of fins, which are stacked alternately, an end plate disposed at an outermost position of said stacked heat transfer tubes and fins in a stacking direction, and an inlet pipe and an outlet pipe connected to said end plate, said heat exchanger comprising:

a pipe connection plate disposed on said end plate, comprising a pipe insertion hole formed within said pipe connection plate, into which at least one of said inlet and outlet pipes is inserted and which temporarily fixes an end portion of an inserted pipe in said pipe insertion hole, wherein said connection plate comprises an inner surface facing said end plate and an outer surface facing away from said end plate, the outer surface of said pipe connection plate is substantially flush with an outer surface of an end plate portion, to which an outermost fin is connected, and an outer edge of said pipe insertion hole is substantially flush with the outer surface of said pipe connection plate.

2. The heat exchanger of claim 1, wherein a surface of said pipe connection plate is covered with a brazing material.

3. The heat exchanger of claim 1, wherein said end portion of said inserted pipe is caulked to said pipe connection plate.

4. The heat exchanger of claim 1, wherein an end surface of said end portion of said inserted pipe is disposed flush with a connection surface of said plate for a pipe connection adjoining said end plate or at a position inward of said connection surface in said pipe insertion hole.

5. The heat exchanger of claim 1, wherein an inner circumferential surface of said pipe insertion hole is formed as a tapered surface.

6. The heat exchanger of claim 1, wherein an inner circumferential surface of said pipe insertion hole is formed as a stepped surface.

7. The heat exchanger of claim 1, wherein a width of said pipe connection plate perpendicular to the stacking direction of said end plate is less than or equal to a width of said end plate.

8. The heat exchanger of claim 1, wherein a mechanism for engaging said pipe connection plate with said end plate is disposed between said pipe connection plate and said end plate.

9. An air conditioning system comprising the heat exchanger of claim 1.

10. The air conditioning system of claim 9, wherein a surface of said pipe connection plate is covered with a brazing material.

11. The air conditioning system of claim 9, wherein said end portion of said inserted pipe is caulked to said pipe connection plate.

12. The air conditioning system of claim 9, wherein an end surface of said end portion of said inserted pipe is disposed flush with a connection surface of said plate for a pipe connection adjoining said end plate or at a position inward of said connection surface in said pipe insertion hole.

13. The air conditioning system of claim 9, wherein an inner circumferential surface of said pipe insertion hole is formed as a tapered surface.

14. The air conditioning system of claim 9, wherein an inner circumferential surface of said pipe insertion hole is formed as a stepped surface.

15. The air conditioning system of claim 9, wherein a width of said pipe connection plate perpendicular to the stacking direction of said end plate is less than or equal to a width of said end plate.

16. The air conditioning system of claim 9, wherein a mechanism for engaging said pipe connection plate with said end plate is disposed between said pipe connection plate and said end plate.

* * * * *